US005782976A

United States Patent [19]

Marziale et al.

[11] Patent Number: 5,782,976

[45] Date of Patent: Jul. 21, 1998

[54] CONTINUOUS COATER BLADE

[75] Inventors: Michael Lawrence Marziale, Paducah, Ky.; Steven Paul Metzler, Covington, Va.

[73] Assignee: Westvaco Corporation, New York, N.Y.

[21] Appl. No.: 884,215

[22] Filed: Jun. 27, 1997

[51] Int. Cl.[6] ..... B05C 11/02

[52] U.S. Cl. ..... 118/118; 118/414; 118/261

[58] Field of Search ..... 15/256.5, 26.53; 118/123, 126, 118, 119, 261, 413, 117, 414; 162/281; 101/162, 425

[56] References Cited

U.S. PATENT DOCUMENTS

| | | |
|---|---|---|
| 2,237,068 | 4/1941 | Bradner . |
| 2,244,859 | 6/1941 | Thiele et al. . |
| 2,320,883 | 6/1943 | Parkinson . |
| 2,466,734 | 4/1949 | Piazze . |
| 3,085,275 | 4/1963 | Allison . |
| 3,781,107 | 12/1973 | Ruhland . |
| 4,122,799 | 10/1978 | Ortega . |
| 4,165,965 | 8/1979 | Bernardelli et al. . |
| 4,877,122 | 10/1989 | Morin . |
| 4,957,770 | 9/1990 | Howarth . |
| 5,007,132 | 4/1991 | Reid et al. . |
| 5,066,364 | 11/1991 | Goodnow et al. . |
| 5,074,776 | 12/1991 | Hassell et al. . |
| 5,138,740 | 8/1992 | Goodnow et al. . |
| 5,264,035 | 11/1993 | Beisswanger et al. . |
| 5,401,315 | 3/1995 | Salo et al. . |
| 5,439,520 | 8/1995 | Reich . |

OTHER PUBLICATIONS

Bob Austin, "The Continuous Crepe—Technology for a Better Tissue Product," *PaperAge*, Feb. '97, pp. 14–15.

*Primary Examiner*—Brenda A. Lamb

*Attorney, Agent, or Firm*—J. R. McDaniel; R. L. Schmalz

[57] ABSTRACT

This invention relates to coater blades which are employed in papermaking machines. Such structures of this type, generally, employ a continuous coater blade located across the width of the papermachine which provides a new section of blade at desired rates or intervals.

18 Claims, 4 Drawing Sheets

CONTINUOUS COATER BLADE

BACKGROUND OF THE INVENTION

1. Field Of The Invention

This invention relates to coater blades which are employed in papermaking machines. Such structures of this type, generally, employ a continuous coater blade located across the width of the papermachine which provides a new section of blade at desired rates or intervals.

The paper or board manufactured for publication or packaging applications is frequently coated prior to printing. Properties such as opacity, gloss, smoothness, and "printability" of a coated sheet are far improved over those of an uncoated sheet. Typically, the coating is applied as a liquid mixture of clay, pigments, starch and/or other binders.

Different types of coaters are used within the papermaking industry, but it is generally accepted that the highest quality coated paper surface is that obtained using a blade coater. The blade of this type coater scrapes or "doctors" off excess coating to leave a smooth, glossy surface on the paper sheet. Any imperfection in the blade or its working edge will cause scratches and/or a nonuniform application of the coating. Also, because the coating itself contains abrasive particles, the coater blade edge is subjected to continuous and adverse wear. Therefore, in order to maintain sheet quality, the coater blades on a papermachine must be changed out at regular intervals.

These regular intervals, typically, are on the order of 2–6 times a day, and sometimes more. Production losses are incurred due to the time needed to replace a blade and also because the operation of a new blade usually requires adjustment before satisfactory results (i.e., uniform coat weight distribution across the width of the machine) are obtained. Description Of The Related Art It is known, that production loses due to coater blade changes on a papermachine or coating line can be reduced, but not eliminated, by scheduling blade changes to coincide with other small maintenance items that can be carried out while the machine runs. A recent development is the use of a wear resistant coater blade with a ceramic edge. Such blades can last several times longer than conventional steel blades, but regular replacement is still required. Therefore, lost production is still substantial, and the ceramic blades cost more than the standard steel ones.

It is also known to employ the use of a continuous blade in a continuous crepe system. Exemplary of such prior art is U.S. Pat. No. 5,007,132 ('132) to Reid et al., entitled "Hydraulic Drive For Pull Through Doctor Blade Transfer System". While the '132 reference employs the use of a continuous blade, the blade is tugged along the width of the paper by intermittently driven clamps in order to form the crepe in the paper. However, such a tug-like movement would adversely affect the smoothness and quality of coating on the coated board. If the blade was tugged only partially across the width of the sheet as shown in the '132, streaks or scratches would develop on the coating. Therefore, a more advantageous coating system, then, would be presented if such an intermittent, tugging movement of the coater blade could be eliminated.

Finally, it is known, to employ the use of a continuous coater blade which is not intermittently driven. Exemplary of such prior art is U.S. Pat. No. 5,264,035 ('035) to R. Beisswanger et al., entitled "Doctor Holder For A Coating Device". While the '035 reference employs the use of continuous coater blade, the clamping mechanism employed by the '035 reference is complex and incorporates numerous guide elements such as sprockets or ball bearings which engage perforations in the coater blade to restrain it within its mounting slot. No provision for sealing these moving parts from the coating solution is made: the abrasive clay suspension is free to flow through the blade perforations to contaminate the guide apparatus to cause premature wear. Most importantly the inevitable buildup of dried coating residue behind the blade will obstruct the guide slot and jam its moving parts. Consequently, a more further advantageous coating system, then, would be presented if the blade could be properly retained and traversed with no leakage of coating, all while adequately coating the paper.

It is apparent from the above that there exists a need in the art for a coater system which employs a coater blade, and which is capable of being operated continuously, but which at the same time is able to adequately retain and traverse the blade without abrasive wear and jamming. It is a purpose of this invention to fulfill this and other needs in the art in a manner more apparent to the skilled artisan once given the following disclosure.

SUMMARY OF THE INVENTION

Generally speaking, this invention fulfills these needs by providing a continuous coater blade assembly, comprising a base means, a blade adjustment means operatively connected to the base means, a blade clamping means operatively connected to the base means and the blade adjustment means, and a continuous blade means slidingly connected to the blade clamping means wherein the blade means is further comprised of a sliding seal means rigidly attached and adjacent to one end of the blade means.

In certain preferred embodiments, the blade clamping means includes a blade clamping hose, a blade faceplate, and a seal backing plate having a seal wear surface insert. Also, the sliding polymeric seal is chosen to be of a fairly hard composition to minimize deformation and sliding friction. Finally, the blade faceplate is constructed of high density polyethylene (HDPE) or Teflon®.

In another further preferred embodiment, the continuous coater blade can be pulled through the coater head and across the width of the paper, at either a slow, continuous rate, or at periodical intervals such that an all-new sectional blade is pulled into position. In this manner, production losses, due to coater blade change over, will be reduced.

The preferred coater blade system, according to this invention, offers the following advantages: continuous coating operation; good stability; good durability; good economy; excellent coating characteristics; and high strength for safety. In fact, in many of the preferred embodiments, these factors of continuous coating operation, durability and coating characteristics are optimized to the extent that is considerably higher than heretofore achieved in prior, known coater blade systems.

The above and other features of the present invention, which will become more apparent as the description proceeds, are best understood by considering the following detailed description in conjunction with the accompanying drawings, wherein like characters represent like parts throughout the several views and in which:

DETAILED DESCRIPTION OF THE INVENTION

Figure 1:
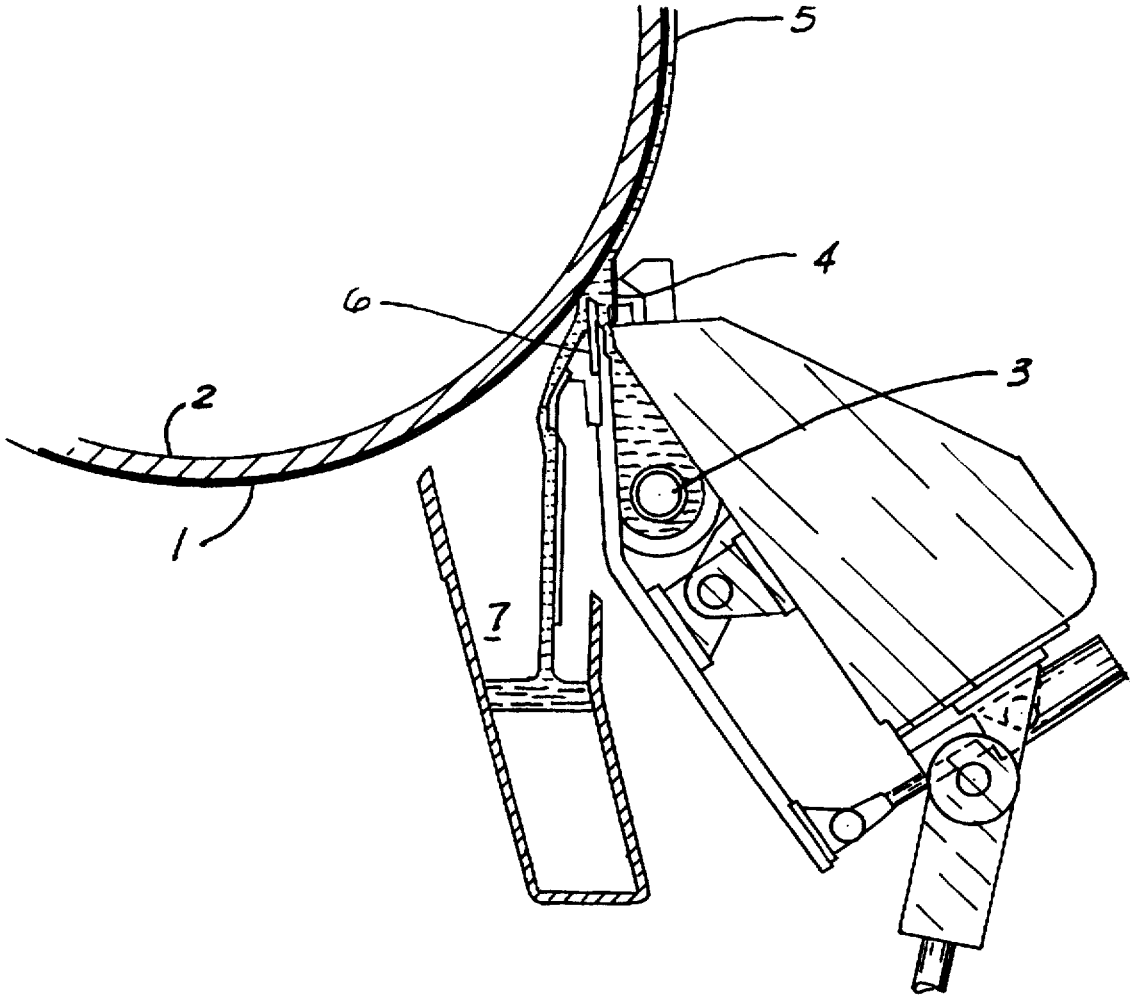
FIG. 1 PRIOR ART
FIG. 1 is a cross-sectional view of a blade coater, according to prior art.

With reference first to FIG. 1, there is illustrated a cross-sectional view of a representative design of a blade coater. The paper sheet or web 1 being coated runs upon the surface of a backing roll 2. The coating is piped to a distribution header 3 and is applied to web 1 as it passes underneath coater blade 4. Blade 4 doctors excess coating off web 1 to leave a thin film 5, the thickness of which is exaggerated in the drawing. Coating, not applied to web 1, flows over a baffle 6 and is collected in a trough 7 for reuse. It should be noted that the application of the coating to the sheet in the manner described above, is known as a "short dwell" application.

Another common method is to have a second applicator or metering roll mounted beneath the backing roll. This metering roll forms a nip with the backing roll and at the same time is partly immersed in a vat of coating. As the paper web passes through the nip, it picks up the film of coating carried on the surface of the metering roll, in a manner analogous to a rotary printing process. However, regardless of the coating application method used, a blade is employed as shown in FIG. 1.

Figure 2:
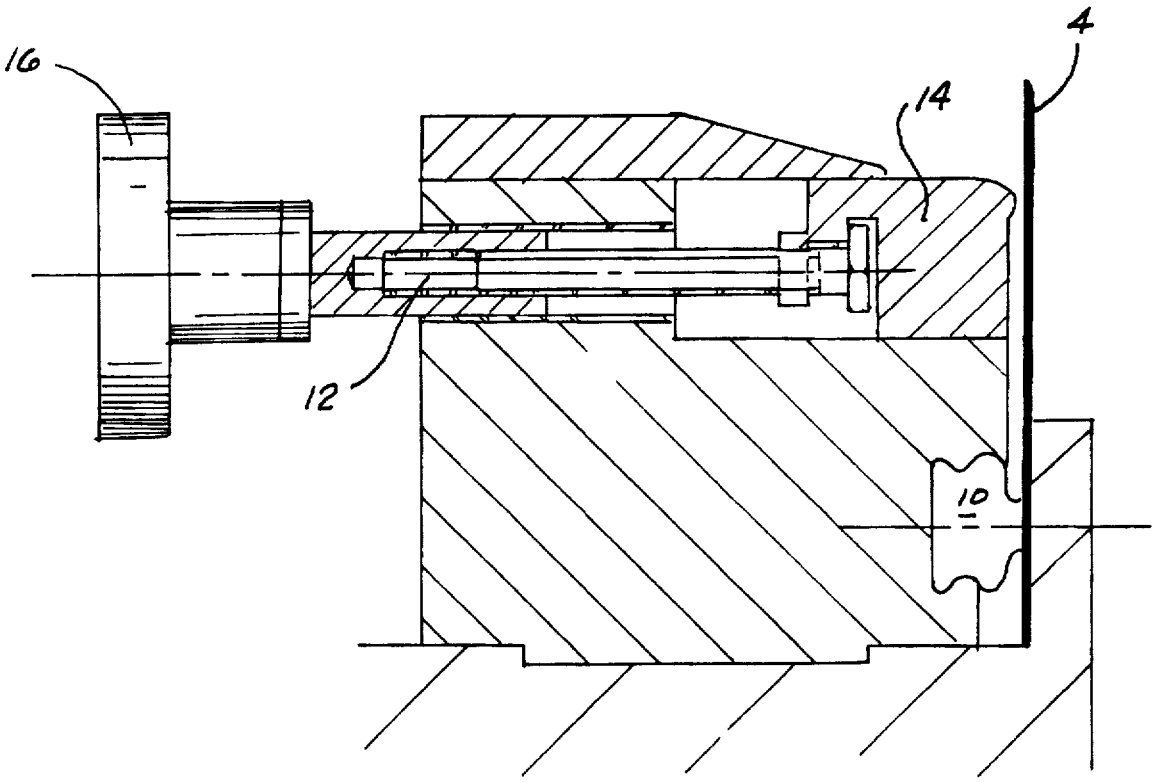
FIG. 2 PRIOR ART
FIG. 2 is a cross-sectional view of a conventional coater blade/mount assembly, according to the prior art.

A closeup cross-sectional view of a conventional blade and its mounting assembly is shown in FIG. 2. It should be pointed out that the orientation of the drawing of FIG. 2 is reversed from that of FIG. 1. Blade 4 is clamped all along its length by an inflatable hose 10. Adjusting screws 12 equally spaced along the length of the blade push on "thrust bar" 14 to adjust the contact force between blade 4 and moving web 1 (FIG. 1). This enables pointwise control over the amount of coating applied to web 1. Screws 12 may be turned by handwheels 16 or they may be motorized for automatic control via computer (not shown).

Figure 3:
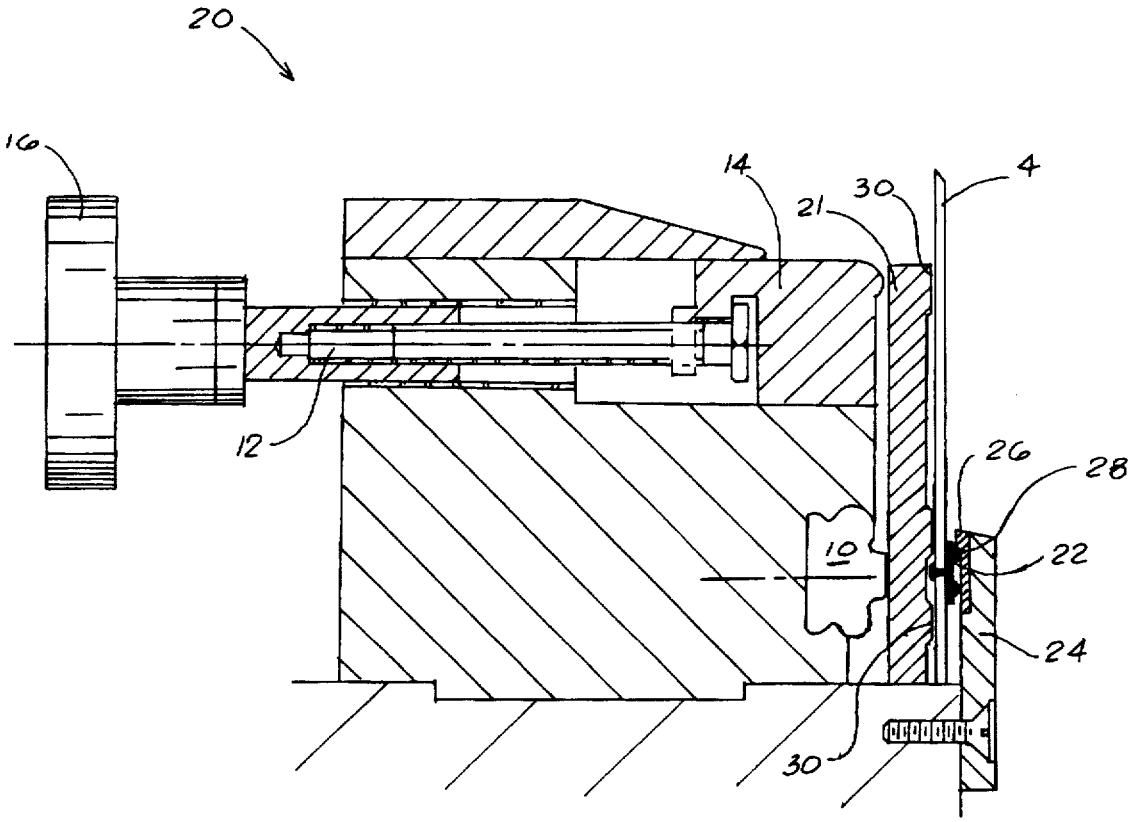
FIG. 3 is a cross-sectional view of a continuous coater blade/mount assembly, according to the present invention.

FIG. 3 is a closeup, cross-sectional view of a continuous coater blade and its mounting assembly 20. Blade 4 is appreciably the same as before, with the addition of blade faceplate 21, sliding seal 22, seal backing plate 24, and insert 26.

Seal 22, preferably, is constructed of a fairly hard synthetic polymeric material (e.g., Teflon®or polytetrafluoroethylene) to minimize deformation and sliding friction. Seal 22 is a part of blade 4 and so must be securely attached or bonded to the body of blade 4 by conventional techniques. It should be noted that seal 22 is located on blade 4 such that the perforation or holes in blade 4 should not be located directly across from the raised areas of seals 22 which contacts insert 26. Also, hose 10 is located directly across from seal 22 to provide a uniform application of pressure centered upon the raised areas of seal 22. Finally, several lands 30 are located on each side of seal 22 in order to further provide uniform pressure across seal 22 and thus a stable application of force.

Backing plate 24, against which seal 22 runs, is made removable because in time the face that contacts seal 22 will wear. It may be advantageous to surface with conventional techniques (e.g., plasmic spray, etc.) the face of seal backing plate 24 with an extremely hard material (carbide, nitride or ceramic) or as shown in FIG. 3 to incorporate an insert 26 made of wear resistant high density polyethylene (HDPE) or Teflon®. This facing/insert 26 also has a small lip 28 that rides against the upper-most portion of sliding seal 22 to retain blade 4 securely.

Directly opposite sliding seal 22, on the backside of blade 4, is a blade clamping hose 10 identical to that shown in FIG. 2. The same type adjusting screws 12 and thrust bar 14 are also used as before to exert pointwise control over the amount of coating applied.

In order for the blade 4 to slide through the coating head 20 with minimal friction, a stationary faceplate 21 is used to separate the back side of blade 4 from clamping hose 10 and adjusting screw thrust bar 14. As with seal backing plate insert 26, faceplate 21 is made of HDPE or Teflon®. Lands 30, on the blade side of the faceplate 20, reduce the amount of "sliding area" that contacts blade 4, and also control the points at which force is applied to blade 4 so that blade 4 is free to flex in the desired manner.

Figure 4:
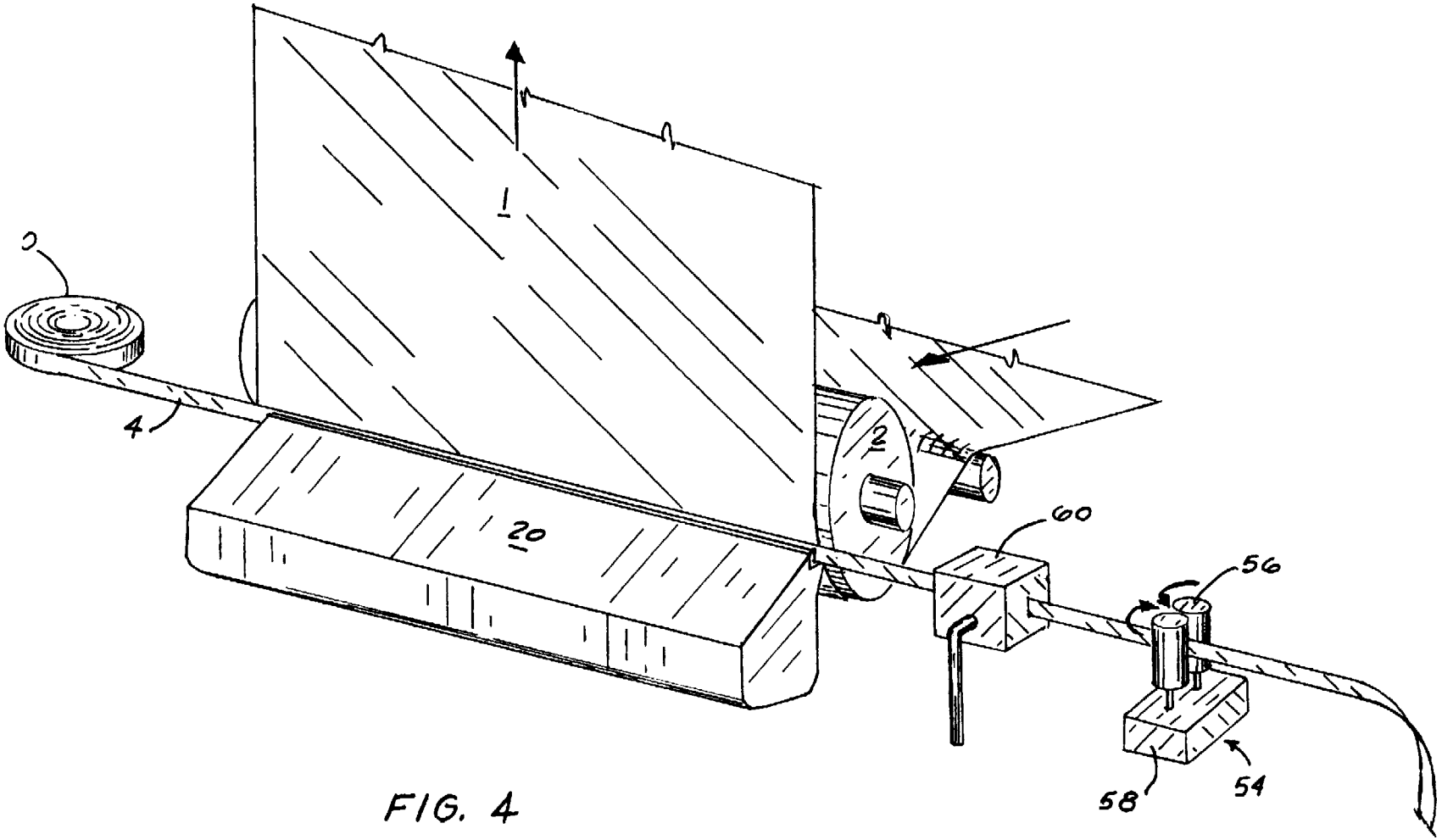
FIG. 4 is an isometric view of a coater head with a continuous blade, according to the present invention.

FIG. 4 is an overall view of continuous blade coating assembly 20 equipped with a continuous blade 4, according to the present invention. Paper web 1 passes between backing roll 2 and coating head assembly 20. Blade 4 is dispensed from a conventional supply reel 50 and is pulled through the blade coating head 20. Blade 4 is pulled by drive unit 54, which preferably, consists of conventional knurled steel rollers 56 turned by a conventional variable speed motor 60 via conventional reduction gears (motor and reduction gear assembly not shown in detail but represented by 58). High "nip loading" of the rollers 56 plus their knurled surface enables a high tension pull without slippage or tugging. Any dried coating that accumulates on blade 4 is removed prior to drive unit 58, by washbox 60, which encloses high pressure showers and rotating steel brushes (not shown) for cleaning the blade.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A continuous coater blade assembly for application of coating onto a moving web, wherein said assembly is comprised of:

a base means;

a blade adjustment means operatively connected to said base means;

a blade clamping means operatively connected to said base means and said blade adjustment means; and a continuous blade means slidingly connected to said blade clamping means wherein said blade means is further comprised of a sliding seal means rigidly attached and adjacent to one end of said blade means.

2. The assembly, as in claim 1, wherein said blade clamping means is further comprised of:

a blade clamping hose means pneumatically connected to said base means;

a blade faceplate means operatively connected to said blade clamping hose means; and a backing plate means rigidly attached to said base means.

3. The assembly, as in claim 2, wherein said blade faceplate means is further comprised of:

a plurality of lands located along a length of said blade faceplate means.

4. The assembly, as in claim 2, wherein said backing plate means is further comprised of:

a wear surface insert means located adjacent to one end of said backing plate means and in contact with said sliding seal means.

5. The assembly, as in claim 4, wherein said insert means is further comprised of:

a lip located along one end of said insert means.

6. The assembly, as in claim 4, wherein said insert is constructed of:

high density polyethylene.

7. The assembly, as in claim 4, wherein said insert is constructed of an extremely hard and wear resistant ceramic material.

8. The assembly, as in claim 4, wherein said insert is constructed of:

polytetrafluoroethylene.

9. The assembly, as in claim 2, wherein said blade faceplate is constructed of:

high density polyethylene.

10. The assembly, as in claim 2, wherein said blade faceplate is constructed of:

polytetrafluoroethylene.

11. The assembly, as in claim 1, wherein said blade adjustment means is further comprised of:

a thrust bar means which contacts said base means and said blade means;

an adjusting screw means threadedly connected to said thrust bar means; and an adjustment screw turning means operatively attached to said adjusting screw means.

12. The assembly, as in claim 11, wherein said adjusting screw turning means is further comprised of:

a handwheel.

13. The assembly, as in claim 1, where said sliding seal means is further comprised of:

a plurality of raised areas located along a length of said seal.

14. The assembly, as in claim 1, wherein said sliding seal means is further comprised of:

synthetic polymeric material to minimize deformation and sliding friction.

15. The assembly, as in claim 14, wherein said synthetic polymeric material is:

polytetrafluoroethylene.

16. The assembly, as in claim 1, wherein said assembly is further comprised of:

a blade supply means;

a blade washing means located upstream of said blade supply means; and a blade traversing means located upstream of said blade washing means.

17. The assembly, as in claim 16, wherein said blade traversing means is further comprised of:

a roller means which contacts said continuous blade means; and a motor means operatively connected to said roller means.

18. The assembly, as in claim 17, wherein said roller means is further comprised of:

at least two knurled rollers located adjacent to each other.

* * * * *